United States Patent [19]

Fournier et al.

[11] Patent Number: 5,033,072

[45] Date of Patent: Jul. 16, 1991

[54] SELF-LIMITING X-RAY TUBE WITH FLAT CATHODE AND STAIR-STEP FOCUSING DEVICE

[75] Inventors: Guillaume Fournier, Paris; Francois Caire, Gagny; Gilles Lemestreallan, Issy Les Moulineaux, all of France

[73] Assignee: General Electric CGR S.A., Moulineaux, France

[21] Appl. No.: 373,572

[22] Filed: Jun. 30, 1989

[30] Foreign Application Priority Data

Jul. 1, 1988 [FR] France ..... 88 08961

[51] Int. Cl.[5] ..... H01J 35/14

[52] U.S. Cl. ..... 378/138; 378/136; 378/137; 313/37; 313/453

[58] Field of Search ..... 378/136, 137, 138; 313/37, 453

[56] References Cited

U.S. PATENT DOCUMENTS

| | | | |
|---|---|---|---|
| 1,923,876 | 2/1931 | Mutscheller . | |
| 2,564,743 | 8/1951 | Wang | 313/453 |
| 2,726,346 | 12/1955 | Busby et al. | 313/37 |
| 4,344,011 | 8/1982 | Hayashi et al. | 313/453 |
| 4,764,947 | 8/1988 | Lesensky | 378/136 |
| 4,777,642 | 10/1988 | Ono | 378/138 |
| 4,788,705 | 11/1988 | Anderson | 378/121 |
| 4,868,842 | 9/1989 | Dowd | 378/136 |

FOREIGN PATENT DOCUMENTS 416533 6/1921 Fed. Rep. of Germany .

OTHER PUBLICATIONS

Patent Abstracts of Japan, vol. 2, No. 64, (E-33)[2148], May 17, 1978, p. 2148 E 78; & JP-A-53 30 292 (Tokyo Shibaura Denki K.K.).

Patent Abstracts of Japan, vol. 4, No. 157 (E-32)[639], Nov. 4, 1980, p. 131 E 32; & JP-A-55 108 158 (Hitachi Seisakusho K.K.).

*Primary Examiner*—Edward P. Westin
*Assistant Examiner*—Kim-Kwok Chu
*Attorney, Agent, or Firm*—Oblon, Spivak, McClelland, Maier & Neustadt

[57] ABSTRACT

Problems of thermal resistance of the anode of an x-ray tube are solved by constructing a flat cathode which is set within a stair-step focusing device. It is shown that, depending on the shape of this device, the heat output on the anode is limited by a saturation value which is lower than a limit of thermal resistance of the x-ray tube. In order to improve the thermal resistance of the cathode, a cathode is constructed in the form of a hollow beam. This ensures rigidity of the cathode which is inherent in its beam shape without being attended by the disadvantages of excessive thermal inertia.

7 Claims, 2 Drawing Sheets

SELF-LIMITING X-RAY TUBE WITH FLAT CATHODE AND STAIR-STEP FOCUSING DEVICE

BACKGROUND OF THE INVENTION

1. Field of the Invention

The present invention relates to an x-ray tube with self-limitation of the electron flux by saturation, for use in particular in the medical field. The main characteristics of these tubes are resistance to drift of their emission characteristics as a function of their temperature as well as homogeneity of the x-ray illumination produced by all the points of their focus. The aim of the invention is to improve such tubes while guarding against any danger of destruction under the action of overheating of their anode.

2. Description of the Prior Art

In general terms, x-rays are produced by electron bombardment, within a vacuum enclosure, of a target fabricated from material having a high atomic number. The electrons which are necessary for bombardment of said target are liberated by thermoelectronic effect, usually in a helical filament of tungsten, of a cathode placed with precision within a concentration component. The concentration component performs a focusing function at the same time as a Wehnelt function. The target is constituted by the anode of the x-ray tube. In this very conventional type of configuration, the initial velocities of the electrons at the level of the emitter are highly dispersed. Their trajectories therefore have a disordered structure and the focusing system provides a correcting function but does not usually have sufficiently high performance characteristics. In consequence, instead of an impact of bombardment electrons on the target, there is obtained a fairly complicated entanglement of trajectories. This provides the thermal focus of the x-rays with an energy profile which is hardly compatible with good quality of the image.

In recent developments, for example in those described in European patent Application No. 85 106753.8 filed on May 31, 1985, reference is made to a cathode which is no longer constituted by a filament but is constituted by a portion of strip provided for emission of electrons with a flat surface located opposite to the anode. The advantage of employing a flat electron emitter has already been presented prior to this Application. It consists in maintaining a certain cohesion of the electronic charges during their trajectory towards the target. Experience has in fact shown that there is obtained in this case a distribution of electrostatic potential which is conducive to better focusing of the electric charges. The x-ray focus thus obtained accordingly exhibits a practically homogeneous energy profile which has a favorable effect on the quality of the image. The scientific literature records certain experiments which are based on this general principle and in which use is always made of an emitter constructed in the form of a tungsten strip.

However, these strips are systematically attended by problems of thermomechanical strength. It was in fact with a view to solving such problems that the European patent Application cited above was filed. In particular, in spite of all the care and attention devoted to rolling of the strips, these strips are subjected to differential stress phenomena and, as a result of successive heating and cooling within the x-ray tube, acquire a so-called corrugated-sheet appearance. The advantages arising from the use of a flat emitter are then lost.

In addition to these defects, flat emitters or even filament emitters have a disadvantage in that the shape of the energy profile of the focus varies in an uncontrolled manner with the load on the x-ray tube. The tube load corresponds to the x-ray delivery. This delivery is related to the magnitude of the thermoelectronic effect in the cathode at the temperature of this latter. In point of fact, more and more radiology devices are provided with regulating circuits for regulating the tube load. This regulation takes into account the x-ray absorption coefficient of a given patient to be examined, with a view to ensuring that the radiation which passes through the patient is limited to a minimum. As can be understood, this regulation acts on the heating circuit of the cathode. The technique whereby regulation tends to produce action on the high voltage between anode and cathode has been abandoned in view of the fact that, in this technique, the hardness of the x-radiation employed has to be modified while an examination is in progress.

Modification of the tube load is not without effect on the energy distribution of the focus. Particularly in certain situations, by reason of the modification of said tube load, the energy densities attained at certain points of the anode may possibly exceed the thermal densities which are acceptable for this anode, in which case the anode is liable to be destroyed. The phenomena of expansion and compression of useful surfaces of the thermal focus are essentially related to the magnitude of the space charge transported by the electrons before impinging upon the target. It is also necessary to relate the magnitude of said space charge to the high voltage which is necessary for detachment of the electrodes from the cathode.

Consideration could also be given to the possibility of modifying the function of the focusing member as a function of the space charge in order to limit, for example, the destructive effects of an excessively abrupt increase in thermal density of the focus. Apart from the complexity of a control system of this type which cannot be contemplated in the present state of the art, it would be necessary to ensure in addition that this control system is capable of rapidly anticipating thermal drift and thermal density of the focus. This solution is not possible at the present time.

In consequence, in the present state of the art, regulation applied to the tube load automatically produces a variation in x-ray illumination and therefore affects the quality of the resultant images. In the final analysis, the heterogeneous character of the combined effects of the space charge and of the high voltage (of the tube load) does not make it possible to obtain tubes in which at least certain emission characteristics would be controlled irrespective of the load.

The aim of the present invention is to overcome this drawback by proposing a flat emitter device having the advantage of offering a degree of mechanical strength which makes it possible to remove the problems of corrugation mentioned earlier. The solution to the problems of limitation of thermal density along the focus as a function of the load on the tube may accordingly be provided by the installation of said flat cathode within a so-called stair-step focusing member. It has in fact been discovered that self-.regulation of the characteristics of said focus takes place in this case. It is accordingly possible in particular to ensure that the quotient of the electron flow rate by the focal surface area is maintained within limits which can be withstood by the target from a thermal standpoint. The advantage of the solution thus presented is that it is applicable over a wide range of high voltage between the anode and the cathode so that one and the same tube can serve for a number of different applications.

SUMMARY OF THE INVENTION

The invention is therefore directed to an x-ray tube provided with a cathode and an anode opposite to the cathode for emitting x-radiation, as distinguished by the fact that the cathode is a flat cathode, said cathode being placed at the base of a stair-step focusing device.

DETAILED DESCRIPTION OF THE INVENTION

Figure 1:
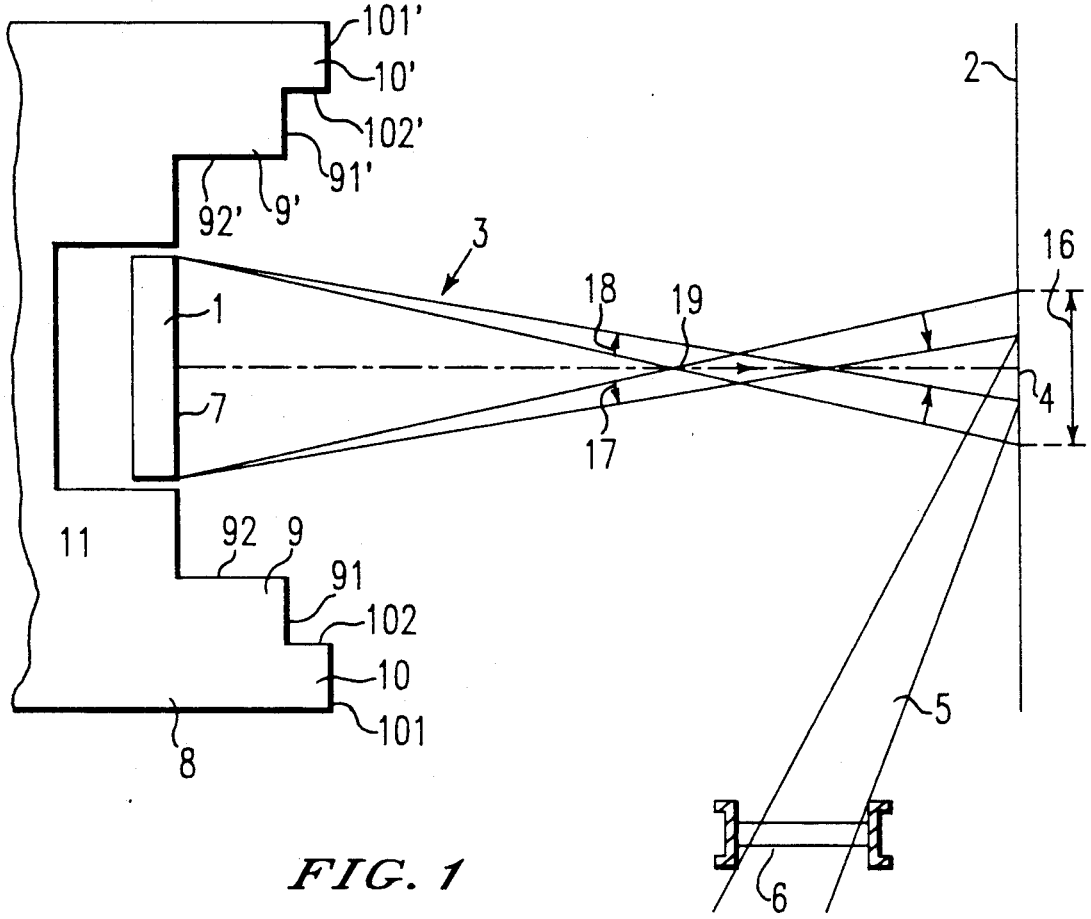
FIG. 1 is a schematic sectional view of an x-ray tube in accordance with the invention.

FIG. 1 shows diagrammatically an x-ray tube in accordance with the invention. Said x-ray tube is provided within a vacuum enclosure (not shown) with a cathode 1 located opposite to an anode 2. The anode receives an electron radiation 3 on its focus 4 and re-emits an x-radiation 5 which is directed in particular to a utilization window 6. The utilization window forms part of the tube envelope. In accordance with the invention, a distinctive feature of the cathode lies in the fact that a flat face 7 is located opposite to the anode 2. Another feature is that said cathode is inserted in a so-called stair-step optical focusing device 8. The object of this stair-step optical device is to produce a distribution of the electric field between the anode and the cathode such that the electron radiation 3 is of the convergent type. Two types of convergent radiation are distinguished. In a first type shown in FIG. 1, the point of convergence of the electrons is located in front of the plane of the anode and is real. In this case, the radiation is known as crossed. In a second type of radiation or so-called direct radiation, the point of convergence of the electrons is located behind the anode 2 and is virtual.

Although the focusing device 8 can consist of a single step, it has been found more advantageous in this case to provide a double step. The focusing member 8 has a prismatic shape, the right section plane of which is shown in FIG. 1. The member 8 has two stair-steps designated respectively by the references 9 and 10 and distributed symmetrically at 9' and 10' on each side of the cathode 1. Each stair-step has a top face or "tread" 91 or 101 and a riser 92 or 102 (respectively 91', 92', 101', 102'). In a preferred example of construction, the plane 7 of the cathode 1 is located at a distance of approximately 7.5 mm from the anode 2. The treads 91 and 91' of the steps 9 and 9' are located at a distance of approximately 6.5 mm from the anode. The treads 101 and 101' are located at a distance of approximately 6 mm from the plane of the anode 2. The width of the cathode 1 as measured in the right section plane of the prismatic focusing member 8 has a value of 2 mm. The width of a housing 11 in which said cathode is placed within the focusing member 8 has a value of 2.2 mm. The distance between the risers 92 and 92' is approximately 3.65 mm whilst the distance between the risers 101 and 102' is approximately 4.65 mm. It is possible to consider that the risers are thus applied against parallelepipedal cylinders (considered in the theoretical sense of the term) having respective widths of 4 mm and 5 mm. Preferably, the device has a symmetrical shape with respect to a plane which passes through the radiation axis 12 at right angles to the plane of the figure. By way of alternative, however, instead of being prismatic, the assembly can be circular and the axis 12 serves as an axis of revolution for the cathode as well as for the focusing member. The anode 2 may possibly be an anode of the rotating type and may even have a face which is inclined to the axis 12. In this case, the distances indicated are rather the distances measured on said axis 12 between the plane 7 of the cathode and the trace of the axis 12 on the anode 2.

Figure 2:
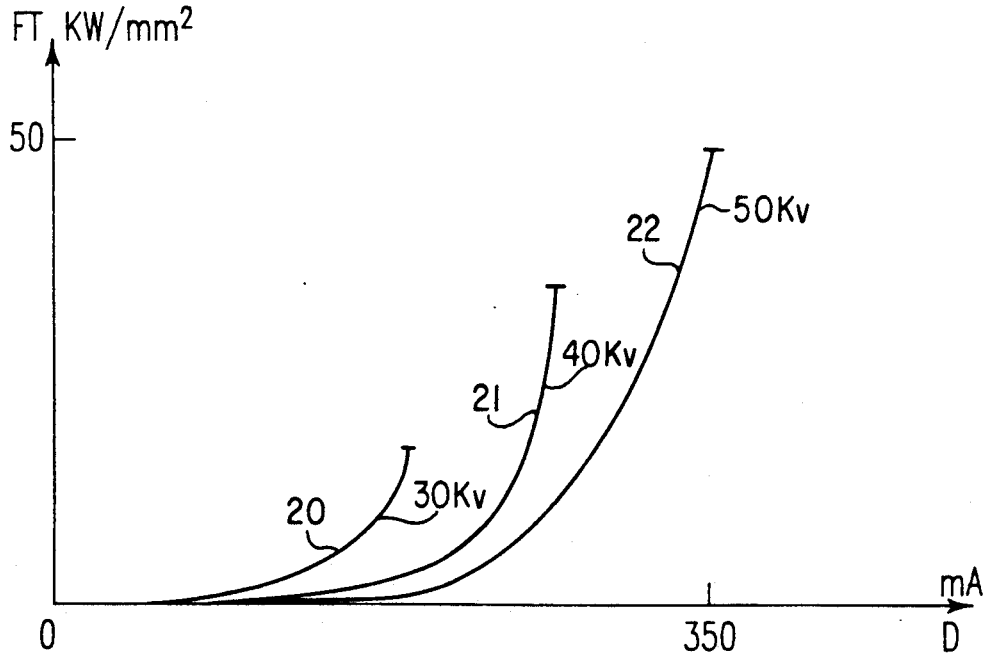
FIG. 2 is an energy diagram for the tube of FIG. 1.

The dimensions given in the foregoing have an advantage in that the thermal flux FT is in this case self-limited in respect of a given utilization high voltage, as a function of the load D on the tube. In fact, the diagram of FIG. 2 shows three curves 20 to 22 respectively having high voltage parameters of 20 KV, 40 KV or 50 KV respectively, indicating a limited course within a utilization load range located between 150 milliamperes and 350 milliamperes. The thermal flux FT is expressed in KW per $mm^2$. In the example considered, the thermal flux is always less than 50 KW per $mm^2$, even at the highest utilization high voltage.

In accordance with the invention in which the radiation 3 is convergent and converges to a point of convergence 19, the increase in the dose rate causes displacement of the point of convergence 19 in the direction of the anode 2. In this radiation of the crossed type, the angular divergence 17, 18 of the lateral rays of the x-radiation beam before the point of convergence 19 results in narrowing of the dimension 16 of the focus. In this invention, it has been discovered that, although this narrowing effect could be disastrous, it is in fact self-limited by a phenomenon of saturation of emission of the electrons detached from the top face 7 of the cathode 1. In fact, by reason of the concentration, the space charge which naturally has a tendency to increase with the load on the x-ray tube (there is a greater number of electrons) increases to such a point as to constitute under certain conditions a screen for emission of the following electrons. This space charge virtually acts as a grid. In the present invention, it has been discovered in particular that this phenomenon could be employed as a self-regulation function on condition that a special optical focusing device is chosen.

This optical focusing device is as described in the foregoing. The device is accordingly provided with stair-steps having the dimensions given. The phenomenon again occurs if one departs from these values. This phenomenon has the advantage of taking place irrespective of the utilization high voltage of the x-ray tube. Understandably, this saturation phenomenon produces a saturation thermal flux on the focus, the value of which depends on said high voltage. In fact, if the high voltage is low, the electrons are relatively less accelerated and the saturation space charge occurs more rapidly. Thus a saturation "bottleneck" is created more readily as the electrons travel at lower velocity. Moreover, it is of interest to note that the curves 20 to 22 showing the different effects of this saturation phenomenon on the thermal flux are substantially vertical as saturation is approached. This means that, in this case, the dimensions of the tube focus are substantially constant and that the images will therefore be acquired in accordance with one and the same procedure irrespective of the load imposed on the x-ray tube by its regulating system. The advantage obtained by the invention is represented by the fact that, at the moment of saturation, the output can no longer increase and above all that the thermal flux can no longer increase either. By correctly choosing the anode and cathode materials or the conditions of utilization of the x ray tubes in such a manner as to ensure that the saturation point is not located outside operating tolerances, the desired result is then obtained.

Figure 3:
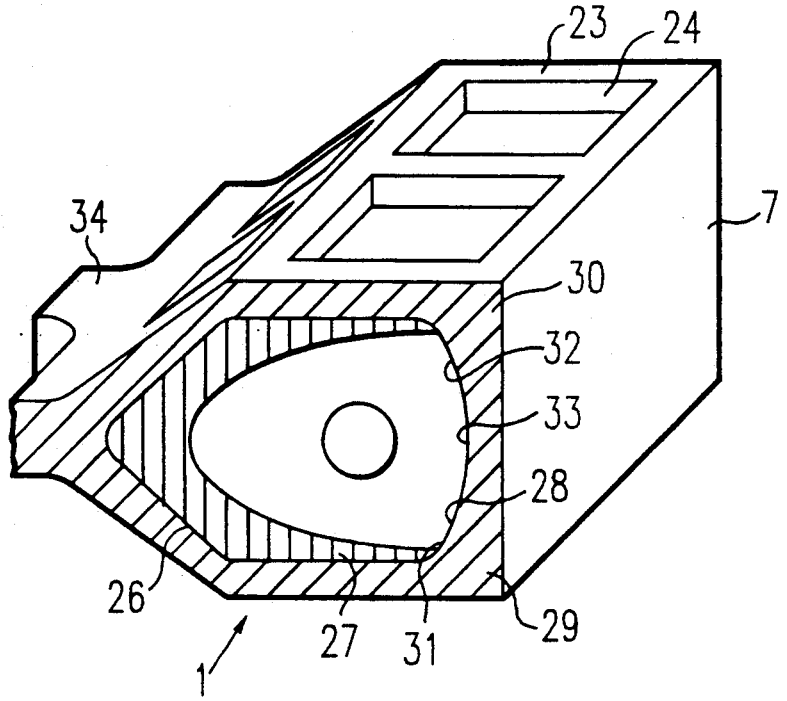
FIG. 3 is a view in perspective showing an example of a rigid cathode employed in accordance with the invention.
Figure 4:
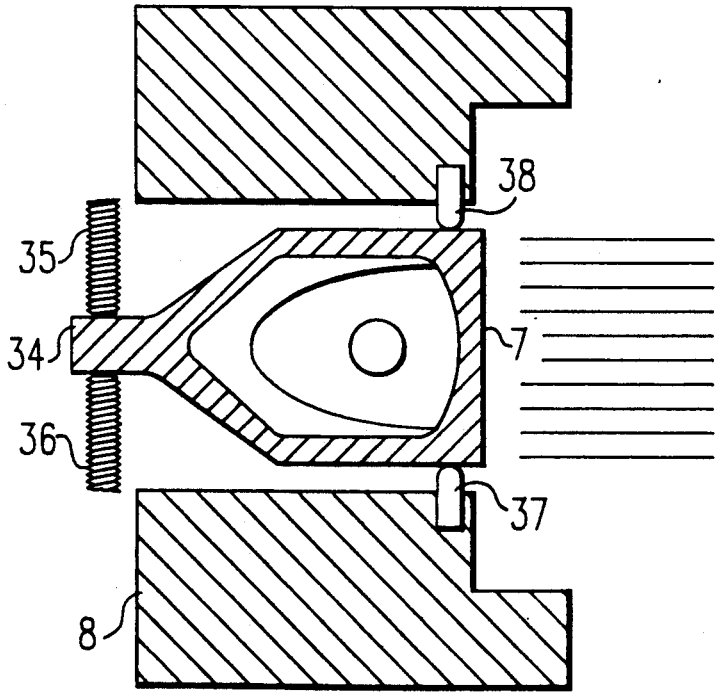
FIG. 4 is a sectional view of the cathode of FIG. 3.

In a preferred example, the cathode 1 has the appearance of a beam as shown in perspective in FIG. 3. This beam is prismatic, of hollow construction, and has substantially the shape of a house. The base of the house constitutes the emissive face 7 of the cathode, the walls of the house such as the wall 23 have windows such as the window 24. The advantage of constructing a hollow beam lies in the reduction of the quantity of metal to be heated. Since this quantity is smaller, the thermal inertia of the cathode is lower and starting of the x-ray tube can be faster. Moreover, the consumption of heating power supplied to the cathode can be reduced, which is an advantage when considering the insulation problems which have to be faced in the heating circuits of cathodes of this type.

Although it is possible to contemplate direct heating of this cathode by passing an electric current directly through this latter, it is preferred to employ a heating filament 25, for example of the same type as a heating element employed in the present state of the technique as an emitter. This filament 25 is itself negatively polarized (several thousand volts) with respect to the cathode 1.

In a preferred example, the beam cathode is made of tungsten. In order to ensure that the quantity of thermal energy to be delivered for heating the cathode is also limited, the ceiling 26 and the interior of the walls of said cathode are provided with a mattress 27 of fibers for concentrating the heating on the emissive portion of the cathode. In one example, the fibers are ceramic fibers which permit good insulation of the internal walls of the house. Accordingly, the electrons emitted by the heating filament bombard the rear portion of the cathode in a pattern represented by the electric field curves 28. This bombardment is limited to the front wall. Moreover, said front wall has a concave profile. In a preferred example, this profile is even concave to such an extent that wings 29 and 30 respectively of said cathode have internal faces 31 and 32 respectively which are closer to the filament 25 than the internal face of the cathode at its midpoint 33. Thus the wings which are of greater thickness and which would be more difficult to heat are nevertheless heated in such a manner as to ensure that the active face of the beam is brought to a substantially constant temperature at all points. In this manner, the required radiation of electrons is emitted at a substantially constant rate.

Although the beam in accordance with the invention now offers an advantage in that its emissive face 7 is no longer subject to distortion under the action of overheating, the beam is nevertheless subject to expansions which have to be guided without restraining them. To this end, the cathode is attached by means of a single lug 34 which virtually constitutes the chimney of the house. The mode of attachment is preferably obtained by locking said lug 34 between two clamping screws 35 and 36 respectively. This assembly with a single point of attachment has the advantage of providing the cathode with all the degrees of freedom which may be desired. It is preferable in particular to a two-point mode of attachment which would be attended by a disadvantage in that the reactions between the two points would inevitably produce harmful effects on the flatness of the emissive surface 7. In order to guide the displacements of the cathode with the temperature, the walls of said cathode are maintained within the focusing member 8 by ceramic studs such as the studs 37 and 38 which are applied against said member on each side. This serves to guard against any phenomenon of bending or vibration which would have an unfavorable effect on accurate positioning of the emitter within the focusing member. The studs permit thermal expansion of the emitter along its greatest length while maintaining it laterally in its reference position. In practice, the supply of electric power to the cathode can be obtained by passing the high voltage through the screws 35 or 36. The focusing member 8 can be decoupled electrically from the beam.

What is claimed is:

1. An X-ray tube with self-limitation of thermal flux comprising a cathode and an anode inside a vacuum enclosure, said anode being located opposite said cathode and said cathode being placed at the base of a stair-step focusing device which is shaped so as to cause said cathode to emit crossed electron beams towards said anode and said cathode being made of a hollow beam having lateral walls and a flat emitting area facing said anode which is heated by an indirect heating device located inside said hollow beam.

2. An X-ray tube according to claim 1 wherein said heating device comprises a heating filament disposed longitudinally inside said hollow beam and a mattress of fibers for concentrating heat radiated by said filament on the internal portion of said hollow beam corresponding to said flat emitting area.

3. An X-ray tube according to claim 2, wherein said internal portion of said hollow beam corresponding to said flat emitting area has a concave shape with wings which are closer to said filament than the central point of said concave internal portion of said hollow beam.

4. An X-ray tube according to claim 1, wherein at least one of the lateral walls of said hollow beam is provided with at least one hollow-out portion.

5. An X-ray tube according to claim 1, wherein said hollow beam is secured to the enclosure of said X-ray tube by means of a single point of attachment.

6. An X-ray tube according to claim 1, wherein said hollow beam is guided by ceramic studs which are fixed on each lateral wall of said hollow beam a well as on said stair-step focusing device.

7. An X-ray tube according to claim 1 wherein, said flat emitting area of said cathode is located at a distance of approximately 7.5 millimeters from said anode, said stair-step focusing device has a double step and has a deep plane common with said flat emitting area and limited by a cylinder having a width of approximately 3.65 millimeters, an intermediate plane located at approximately 6.5 millimeters from said anode and limited by a cylinder of approximately 4.65 millimeters and, an upper plane located at approximately 6 millimeters from said anode.

* * * * *